US012480402B2

(12) United States Patent
Zug et al.

(10) Patent No.: US 12,480,402 B2
(45) Date of Patent: Nov. 25, 2025

(54) CENTERING THE HOUSING PARTS OF AN AXIAL PISTON MACHINE

(71) Applicant: Robert Bosch GmbH, Stuttgart (DE)

(72) Inventors: Martin Zug, Hirrlingen (DE); Stefan Merz, Hechingen (DE); Felix Hoffmann, Baden-Baden Steinbach (DE); Manuel Sell, Horb (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 18/791,637

(22) Filed: Aug. 1, 2024

(65) Prior Publication Data

US 2025/0043684 A1 Feb. 6, 2025

(30) Foreign Application Priority Data

Aug. 4, 2023 (DE) ..... 10 2023 207 507.5

(51) Int. Cl.

| | |
|---|---|
| ***F01B 3/00*** | (2006.01) |
| ***F04B 1/2021*** | (2020.01) |
| ***F04B 1/2028*** | (2020.01) |
| ***F04B 1/2064*** | (2020.01) |
| ***F04B 1/2071*** | (2020.01) |

(52) U.S. Cl.

CPC ..... *F01B 3/0091* (2013.01); *F01B 3/0041* (2013.01); *F01B 3/0047* (2013.01); *F01B 3/005* (2013.01); *F01B 3/0067* (2013.01); *F04B 1/2021* (2013.01); *F04B 1/2028* (2013.01); *F04B 1/2064* (2013.01); *F04B 1/2071* (2013.01)

(58) Field of Classification Search

CPC ..... F01B 3/0041; F01B 3/0047; F01B 3/005; F01B 3/0067; F01B 3/0091; F04B 1/2021; F04B 1/2028; F04B 1/2064; F04B 1/2071

See application file for complete search history.

(56) References Cited

U.S. PATENT DOCUMENTS 2,776,629 A * 1/1957 Keel ..... F01B 3/0073 91/507
3,481,277 A * 12/1969 Pettibone ..... F01B 3/0047 91/507

(Continued)

FOREIGN PATENT DOCUMENTS

DE 10 2015 212 731 A1 1/2017
DE 10 2018 205 884 A1 10/2019

*Primary Examiner* — Matthew Wiblin

(74) *Attorney, Agent, or Firm* — Maginot, Moore & Beck LLP

(57) ABSTRACT

A hydrostatic axial piston machine is disclosed, in the housing of which a drive shaft is rotatably mounted about an axis of rotation. The housing comprises a pot-like housing part having a first abutment and a cover-like housing part having a second abutment. The two abutments are clamped against one another in a sealing manner. A first fitting pin is inserted precisely into a first fitting recess of the first abutment on the one hand and into a second fitting recess of the second abutment on the other hand. A second fitting pin is provided on a side opposite the axis of rotation, which is inserted precisely into a third fitting recess of the first abutment on the one hand and into a fourth fitting recess of the second abutment on the other hand. The second fitting recess has a radial widening relative to the axis of rotation, whereby the second fitting recess is a slotted hole and/or a fitting groove.

16 Claims, 6 Drawing Sheets

(56) References Cited

U.S. PATENT DOCUMENTS

| | | | | |
|---|---|---|---|---|
| 3,657,970 | A * | 4/1972 | Kobayashi | F01B 3/0047 91/487 |
| 5,941,159 | A * | 8/1999 | Hansell | F04B 1/2085 91/499 |
| 7,546,797 | B2 * | 6/2009 | Betz | F04B 1/2078 92/57 |
| 2011/0252958 | A1 * | 10/2011 | Spielvogel | F04B 1/2064 92/12.2 |
| 2018/0252209 | A1 * | 9/2018 | Kane | F04B 53/22 |
| 2019/0178226 | A1 * | 6/2019 | Breuer | F03C 1/0686 |
| 2019/0323489 | A1 * | 10/2019 | Breuer | F04B 49/08 |

* cited by examiner

CENTERING THE HOUSING PARTS OF AN AXIAL PISTON MACHINE

This application claims priority under 35 U.S.C. § 119 to patent application no. DE 10 2023 207 507.5, filed on Aug. 4, 2023 in Germany, the disclosure of which is incorporated herein by reference in its entirety.

The present disclosure relates to the centering and positioning of two housing parts, preferably centering and positioning the two single housing parts of an axial piston machine with a swashplate design.

BACKGROUND

In axial piston machines with a swashplate design, the cylinder drum, which rotates with the drive shaft, is arranged in an at least two-part housing. A first housing part is often pot-like, while a second housing part is cover-like. The drive shaft is mounted in the first housing part on the one hand and in the second housing part on the other hand. If the two work connections of the axial piston machines are formed in the cover-like housing part, this housing part is also called the connection plate.

DE 10 2015 212 731 A1 shows an axial piston machine in which the pot-like housing part is composed of a tubular wall section and a flange, resulting in a three-part housing. The tubular wall section is fastened to the connection plate referred to as the housing cover. A circumferential abutment surface is formed on the wall section and on the housing cover; these abutment surfaces must be pressed against one another in a sealing manner.

DE 10 2018 205 884 A1 discloses the widely used two-part housing design mentioned above with a pot-like and a cover-like housing part.

As the circumferential cylinder drum accommodated in the pot-like housing part is clamped against a stationary distribution plate, which is supported on the cover-like housing part, a high degree of dimensional accuracy is required when positioning the two housing parts in relation to one another.

For this purpose, DE 10 2018 205 884 A1 discloses a circumferential circular cylindrical centering collar or alignment collar on the cover-like housing part, which is inserted precisely into a circular cylindrical inner circumferential section of the pot-like housing part. This ensures that the two housing parts are concentric with one another. The correct rotational position of the two housing parts relative to one another is achieved by two centering pins, each of which are inserted into two pin bores. The two pin bores of the cover-like housing part are arranged outside the circular cylindrical centering collar or alignment collar and opposite each other in relation to the drive shaft of the axial piston machine, while the two pin bores of the pot-like housing part are arranged outside the circular cylindrical inner circumferential section at the corresponding positions.

However, it has been shown that such centering of the two housing parts relative to one another can lead to stresses.

SUMMARY

The object of the present disclosure is to provide straightforward centering and positioning of two housing parts of an axial piston machine relative to one another, in which stresses are avoided.

This object is achieved with the feature combination set forth below.

The hydrostatic axial piston machine according to the disclosure has a housing in which a drive shaft and a cylinder drum coupled thereto in a rotationally fixed manner are rotatably mounted about an axis of rotation. The housing is at least in two parts and has a pot-like housing part with a first abutment and a cover-like housing part with a second abutment. The pot-like housing part (for its part) can also be a multi-part, resulting in a more than two-part housing. The two abutments are clamped together in a sealing manner, e.g., with a flat seal in between. According to the disclosure, a first fitting pin (center pin, alignment pin) is provided, which is inserted precisely in a first fitting recess of the first abutment on the one hand and in a second fitting recess of the second abutment on the other hand, in each case precisely in a radial direction and in a circumferential direction of the axis of rotation. A second fitting pin (center pin, alignment pin) is provided on a side diametrically opposite the axis of rotation, which is inserted precisely in a third fitting recess of the first abutment in the radial direction and in the circumferential direction of the axis of rotation on the one hand, and is inserted in a fourth fitting recess of the second abutment on the other hand. The second fitting recess has a widening in the radial direction relative to the axis of rotation, whereby the second fitting recess is a slotted hole and/or a fitting groove. In the circumferential direction, on the other hand, the second fitting recess has no widening, but is dimensioned as precisely as the first fitting recess and preferably also as the third and fourth fitting recess of the second fitting pin.

In the case of circular cylindrical fitting pins and circular cylindrical fitting recesses, the term "precise" refers to the full extent of the term.

The circular cylindrical centering collar or alignment collar of the cover-like housing part and the precisely fitting edge of the main opening of the pot-like housing part according to the prior art can thus be omitted. This makes it possible to enlarge the main housing opening and deviate from the circular shape of the main housing opening of the pot-like housing compared to the prior art. This results in cost savings in the manufacture and easier assembly of the swivel cradle including the extension spring under the swivel cradle.

In other words: In the prior art, the individual pin bore penetrates a flange section of the cover-like housing part. The pin bores in both housing parts can therefore be (re) drilled, reamed and pinned after assembly using the two cylindrical pins. The tolerance position of the two pin bores in the respective housing parts can lead to stress during assembly, and the housing parts must be positioned in relation to each other (fixture) during assembly. It is precisely this procedure that the disclosure (cylindrical pin and slotted hole or fitting groove in one of the housing parts) is intended to avoid, such that both housing parts can be manufactured independently of one another, while still avoiding any stress on the two cylindrical pins.

Preferably, the radial widening of the fourth fitting recess is only so small that a tolerance-related stress of the two housing parts in the radial direction of the rotational axis is avoided. As a result, the radial widening may not be visible to the naked eye.

Thus, in one exemplary embodiment, the radial expansion of the fourth fitting recess may only be a maximum of 7% greater than the expansion of the fourth fitting recess in the circumferential direction.

Preferably, all four fitting recesses are each configured as a blind hole.

If the two work connections of the axial piston machine are also formed in the cover-like housing part, and if the second abutment of the cover-like housing part is arranged circumferential and in one plane, this housing part is also called a connection plate.

If the two abutments (of the two housing parts) lie in a respective plane and are completely circumferential, and if a flat seal is arranged between the two abutments, then this can have two through-recesses through which the fitting pins extend. The through-hole recess for the first fitting pin then preferably (also) comprises a radial widening relative to the axis of rotation, whereby the through-recess is (also) a slotted hole. Thus, the distance tolerance of the two fitting pins does not cause any deformation of the flat seal, although it is still precisely aligned. Furthermore, incorrect assembly of the flat seal to the two housing parts is thus prevented. This applies in particular if the radial widening of the fourth fitting recess and the radial widening of the through-recess of the flat seal are sized such that they are visible to the installer.

The two housing parts can be fastened to one another in a manner known per se by way of a plurality of screws (e.g., four). Then, the pot-like housing part preferably has blind threaded holes for the screws. This results in a closed outer surface of the cast pot-like housing part in this area.

A distribution plate with two kidney-shaped control openings can be clamped against the cover-like housing part in a manner known per se, one of which functions as a high-pressure kidney and the other a low-pressure kidney during operation of the axial piston machine. If the drive shaft is mounted in the cover-like housing part by way of a rolling bearing (e.g., tapered roller bearing), the stationary distribution plate preferably has a central recess with an inner edge, by way of which the distribution plate is centered and positioned on a stationary outer ring of the rolling bearing.

It is known from DE 10 2018 205 884 A1 that milled radial grooves are provided in an abutment area of the cover-like housing part against which the distribution plate is clamped, which connect the circumferential area of the distribution plate and thus the interior of the axial piston machine with the outer ring of the rolling bearing.

According to the disclosure, at least one (e.g., two) trough-shaped cast radial recess extending in the radial direction is provided in the abutment area of the cover-like housing part against which the distribution plate is clamped. This recess is further formed by the distribution plate into a radial channel section connecting the outer circumferential area of the distribution plate and thus an interior of the housing with the outer ring of the rolling bearing. Milling to form the radial recess is thus omitted.

A control opening (in particular a control bore or a control slot) may be provided in the distribution plate-when viewed in the circumferential direction of the cylinder drum just before the low-pressure kidney-which is fluidically connected to the cast radial recess. This fluidical connection is realized, for example, via a control groove that is formed in the side of the distribution plate that abuts the abutment area of the cover-like housing part. This results in a relief flow path from the cylinder pressurized with high pressure via its mouth or opening provided in the cylinder drum through the control opening of the distribution plate along the control groove and via the radial channel section to the interior of the housing. This relief flow path is known per se from the prior art. This relief flow path is advantageous when the axial piston machine is operating as a pump with a small or minimum swing angle to compensate only for leakage of a circuit with a hydraulic consumer that is under load.

According to the disclosure, it is particularly preferred in this case if a radial outer end section of a groove base of the cast radial recess (in the area of the outer circumferential region or the outer edge of the distribution plate) is inclined or has a slope. This slope may also be referred to as a conductive surface or a conductive ramp for the pressure means. As a result, the pressure means flowing over this relief flow path may be guided away from the flat seal to prevent it from wearing out.

In one embodiment of the slope, it extends at its radial inner (end) section to below the outer edge of the distribution plate. When considering the desired control flow direction of the pressure means from radially inwards to radially outwards, the slope thus already starts radially inside the outer edge of the distribution plate.

The slope may also begin (only) after the outer edge or outside the outer edge of the distribution plate. This may be advantageous, as a cross-sectional constriction of the relief flow path could otherwise take place below the outer edge of the distribution plate.

Preferably, a cast space is formed (viewed along the axis of rotation) axially adjacent to the rolling bearing on a side of the rolling bearing opposite to the distribution plate in the cover-like housing part. An end section of the drive shaft extends into this space. At least one (e.g., two) trough-shaped cast axial recess is formed in an inner case section of the cover-like housing part to which the outer ring of the rolling bearing abuts. The axial recess extends the in axial direction (about parallel to the axis of rotation) and is further formed by the outer ring of the rolling bearing into an axial channel section connecting the first-mentioned radial channel section to the cast space. This means that the outer ring of the rolling bearing does not impede the pressure equalization between the interior of the housing and the cast space.

An additional relief flow path can then also result from the cylinder pressurized with high pressure via its mouth or opening provided in the cylinder drum through the control opening along the control groove and then via the axial channel section to the cast space.

An alignment pin is preferably provided to fix the rotation position of the distribution plate, in particular in cooperation with the inner housing of the distribution plate held on the outer ring of the rolling bearing, which is inserted into an alignment recess of the cover-like housing part on the one hand and into an alignment recess of the distribution plate on the other hand.

In the case of the cast radial recess, the alignment recess of the cover-like housing part may be arranged in the radial outer end of the cast radial recess.

In DE 10 2018 205 884 A1, burrs may form when drilling the alignment recess that must be laboriously removed because the alignment recess intersects a circular circumferential groove. According to the disclosure, it is preferable, however, if the transverse dimensions (in the circumferential direction of the axis of rotation) of the recess in the area of the alignment pin are radially enlarged inwardly compared to the transverse dimensions, such that the alignment pin is surrounded by the radial recess over its entire circumference. With this further development, fewer burrs are created, which can be removed even more easily.

In order to avoid a mechanical weakening of the cover-like housing part, it is preferred if the alignment recess of the cover-like housing part is arranged outside of the radial recess.

The alignment recess can be arranged between two arms of the cast radial recess. Or, the alignment recess is arranged adjacent to the cast radial recess.

The two work connections of the axial piston machine are typically formed on the cover-like housing part.

According to a first preferred further development of the cover-like housing part, a flattened section and/or recess is formed on the outer side of the cover-like housing part between the two work connections, which is set back along the axis of rotation. This serves to save materials.

Preferably, the flattened section and/or recess extend transversely to the axis of rotation up to the edge of the cover-like housing part and up to the work connections. In this way, the cover-like housing part has the required stiffness, wherein in particular the maximum deflection of the cover-like housing part under load is small, so that the flat seal seals properly.

According to a second preferred further development of the cover-like housing part, a pre-compression volume is integrated in the cover-like housing part between the two work connections. The pre-compression volume is configured as a substantially circular cylindrical blind hole, the central axis of which crosses the axis of rotation perpendicularly, wherein the two work connections face perpendicularly away from the central axis. The blind hole may be cast, in which case it is drilled by machining. The open side of the blind hole is sealed with a separate closing screw (with sealing ring) in a fluid-tight manner. A channel (preferably a straight bore) is provided within the cover-like housing part, which connects the pre-compression volume to the distribution plate. A small bore is provided in the distribution plate in the circumferential direction between the two kidney-shaped control openings, such that a cylinder of the cylinder drum is fluidically connected to the pre-compression volume when it is positioned or moved between the kidney-shaped control openings.

DETAILED DESCRIPTION

Two embodiment examples of the present disclosure will be described in the following on the basis of the accompanying figures.

Figure 1:
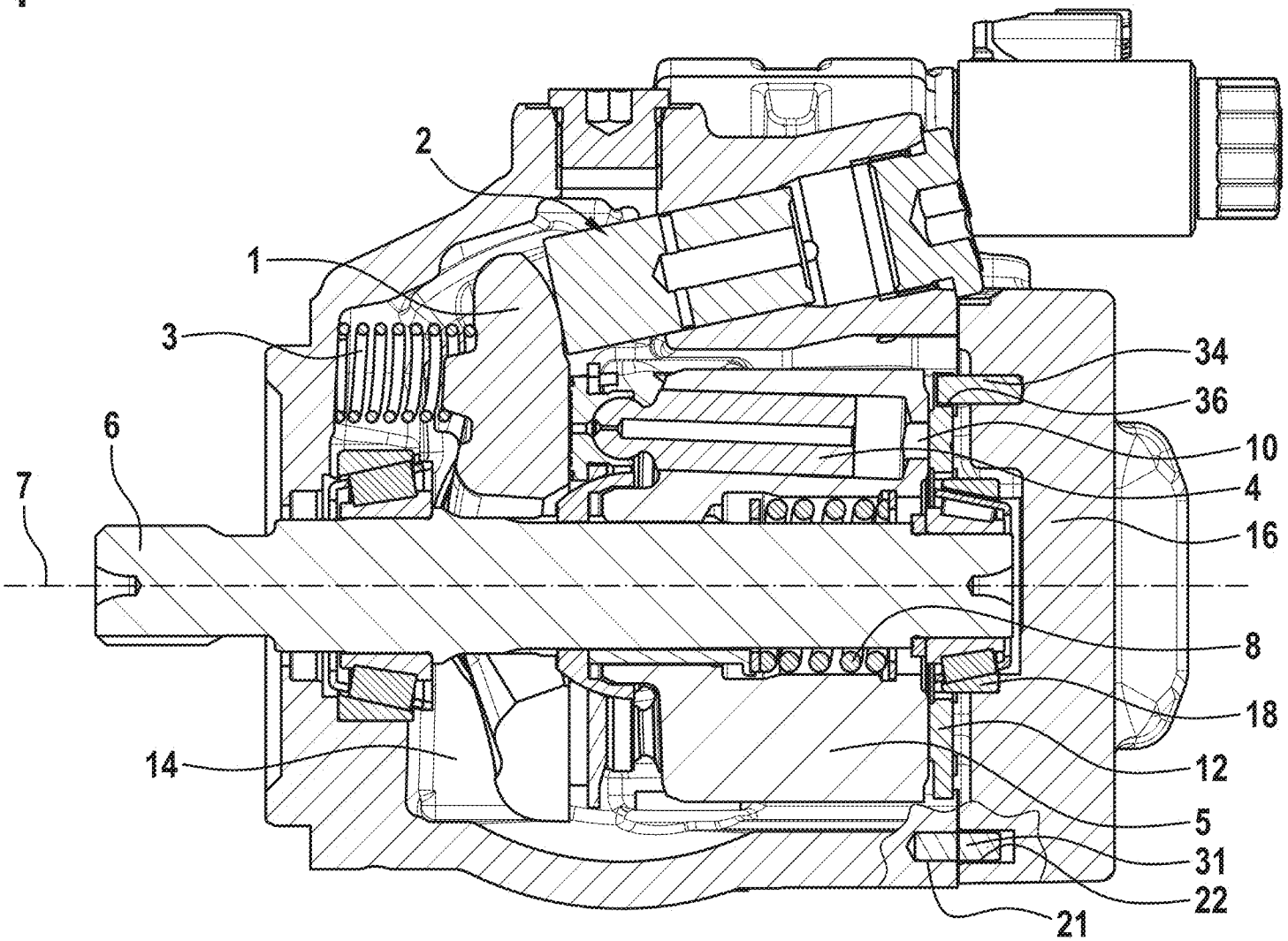
FIG. 1 is an axial piston machine in accordance with a first embodiment of the present disclosure in a longitudinal section.

FIG. 1 shows a hydrostatic axial piston machine in accordance with a first exemplary embodiment of the present disclosure in a longitudinal section. The axial piston machine may operate as a pump and as a motor, wherein its stroke volume is adjustable by way of a pivotable swashplate 1. For this purpose, an adjustment device 2 is provided, by way of which the swashplate 1 can be pivoted against the force of a return spring or an extension spring 3 in the direction of increasing swivel angle and thus increasing stroke volume. A plurality of pistons 4 are distributed around the circumference of a cylinder drum 5 and arranged approximately parallel to a drive shaft 6 and coupled to the swashplate 1. The drive shaft 6 is rotationally fixedly connected to the cylinder drum 5, but the cylinder drum 5 is axially displaceable from the drive shaft 6. The cylinder drum 5 is clamped by way of a compression spring 8 (in FIG. 1 to the right) such that respective circumferential cylinder openings 10 are pressed against a stationary distribution plate 12.

Figure 3:
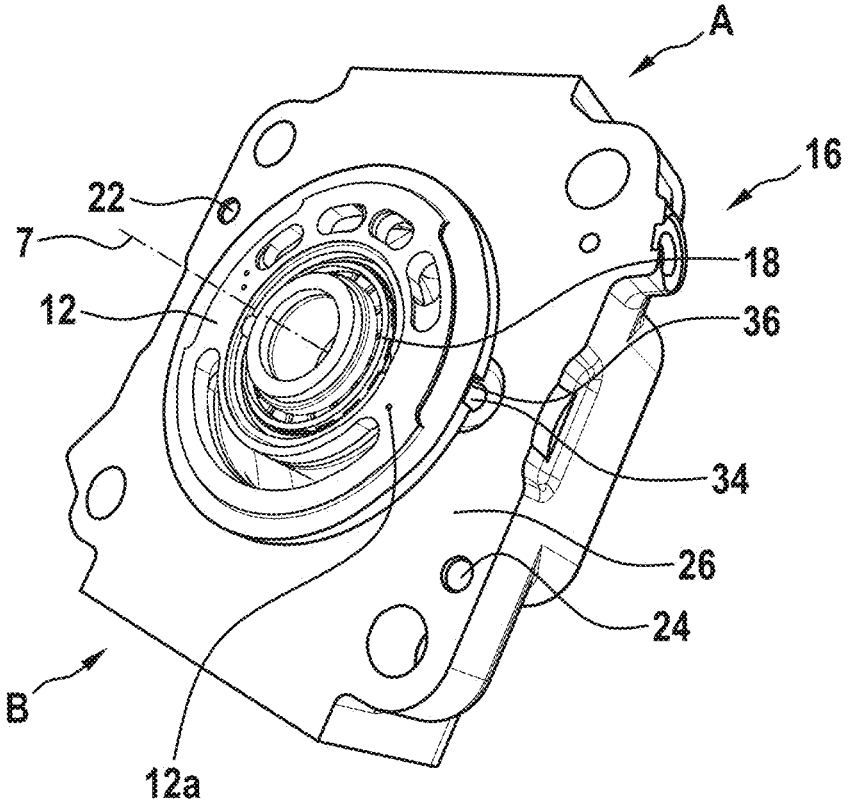
FIG. 3 is a perspective view of a cover-like housing part of the axial piston machine of FIG. 1 with a rolling bearing and with a distribution plate.

FIG. 3 shows the circular disk-shaped distribution plate 12 with the two kidney-shaped control openings, wherein the control opening permanently provided for the high pressure is stabilized with three webs, resulting in four partial openings, while the control opening provided for the low-pressure is continuous.

Referring back to FIG. 1, it can be seen that the axial piston machine comprises a two-piece housing composed of a pot-like housing part 14 (in FIG. 1 on the left) and a cover-like housing part 16 (in FIG. 1 on the right). The drive shaft 6 is mounted with a rolling bearing 18 configured as a tapered roller bearing in the cover-like housing part 16 and with a further tapered roller bearing in the pot-like housing part 14.

Figure 2:
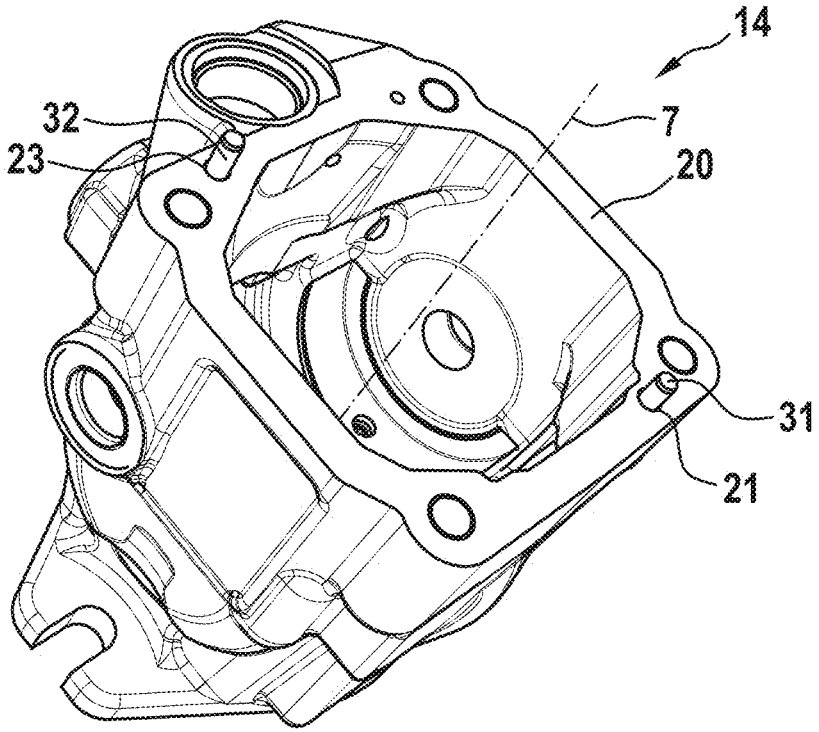
FIG. 2 is a perspective view of a pot-shaped housing part of the axial piston machine of FIG. 1.

FIG. 2 shows a perspective view of the pot-shaped housing part 14 of the axial piston machine of FIG. 1. It can be seen that this housing part 14 has a circumferential flat first abutment 20 in which four blind threaded holes for screws (not shown) are formed, with which this housing part 14 is clamped against the cover-like housing part 16 in a sealing manner. Furthermore, a first fitting recess 21 and a third fitting recess 23, which are also configured as blind holes, are arranged in areas of the first abutment 20 diametrically opposite the axis of rotation 7. In the two fitting recesses, a fitting pin 31, 32 is inserted.

FIG. 3 shows a perspective view of the cover-like housing part 16 of the axial piston machine of FIG. 1. It can be seen that this housing part 16 also has a circumferential flat second abutment 26 in which four through-holes for the screws (not shown) are formed, with which this housing part 16 is clamped against the pot-like housing part 14 in a sealing manner. Furthermore, a second fitting recess 22 and a fourth fitting recess 24, which are also configured as blind holes, are arranged in areas of the second abutment 26 diametrically opposite the axis of rotation 7. In the two fitting recesses 22, 24, one of each of the fitting pins 31, 32 is inserted (shown in FIG. 2).

In the exemplary embodiment shown, the two fitting pins 31, 32 are circular cylindrical and can therefore also be referred to as cylindrical pins. The first and third and fourth fitting recesses 21, 23, 24 are also circular cylindrical and a precise fit. The second fitting recess 22, on the other hand, has a radial widening relative to the axis of rotation 7, while it has no widening around the axis of rotation 7 in the circumferential direction. The second fitting recess 22 is therefore a slotted hole and/or a fitting groove. However, as the widening is so small that the radial extension is less than 107% of the extension in the circumferential direction, the widening is hardly visible in the illustration of FIG. 3. This prevents stresses of the two housing parts 14, 16 when they are assembled and screws together.

Looking at FIG. 2, an advantageous enlargement of the main housing opening and a deviation from the circular shape of the main housing opening of the pot-like housing part 14 is realized compared to the prior art.

With reference to FIG. 3 again, the roller bearings 18 for the drive shaft 6 (see FIG. 1), which is inserted in the cover-like housing part 16 and the distribution plate 12 abutting the cover-like housing part 16 are shown. The stationary distribution plate 12 is centered over the stationary outer ring of the rolling bearing 18. The correct rotational position of the distribution plate 12 is ensured by an alignment pin 34, which is inserted into an alignment recess 35 of the cover-like housing part 16 on the one hand and into an alignment recess 36 of the distribution plate 12 on the other hand. The alignment recess 36 of the distribution plate 12 is arranged directly adjacent to the outer edge 12*c* of the distribution plate 12 and extends in the radial direction up to that outer edge 12*c*.

In the distribution plate 12 in the circumferential direction of the cylinder drum 5 just before the low-pressure kidney, a control opening 12*a*, which is configured as the control bore, is provided and explained in more detail with reference to FIGS. 11 and 12.

Figure 4:
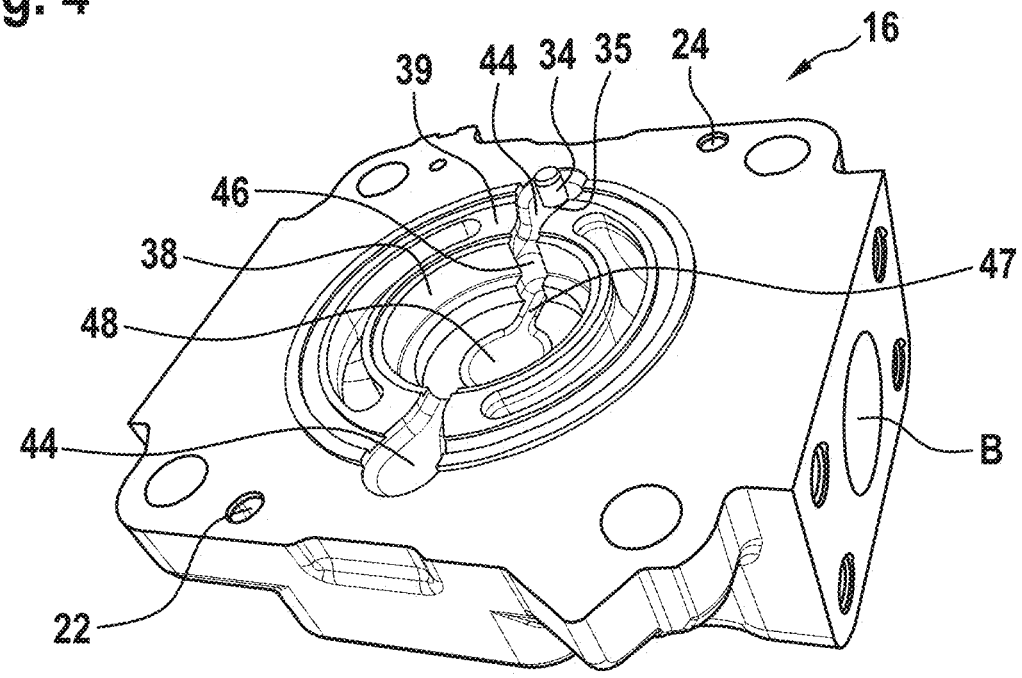
FIG. 4 is a further perspective view of the cover-like housing part of FIG. 3 without rolling bearings and distributor plate.

FIG. 4 shows a further perspective view of the cover-like housing part 16 of FIG. 3, but without the distributor plate 12 and without the rolling bearing 18. An inner case section 38 for the outer ring of the rolling bearing 18 and the abutment area 39 for the distribution plate 12 can thus be seen.

When viewed along the axis of rotation 7, axially adjacent to the rolling bearing 18, a cast space 48 is formed in the cover-like housing part 16, into which an end section of the drive shaft 6 extends. The space 48 is connected to the interior of the housing by two channels opposite to one another relative to the axis of rotation 7 so that a pressure equalization can take place here. The outer ring of the rolling bearing 18 therefore does not impede the pressure equalization with the space 48.

For this pressure equalization, two trough-shaped cast recesses 44 are provided in the abutment area 39 for the distribution plate 12, which extend in a radial direction. These recesses 44 are each further formed by the distribution plate 12 into a radial channel section connecting the outer circumferential area of the distribution plate 12 and thus an interior of the housing with the outer ring of the rolling bearing 18.

Two trough-shaped cast axial recesses 38 are formed in the inner case section 38 of the cover-line housing part 16, against which the outer ring of the rolling bearing 18 abuts, only one of which can be seen in FIG. 4. These recesses 38 extend approximately parallel to the axis of rotation 7 and are each further formed by the outer ring of the rolling bearing 18 into an axial channel section. Finally, two further cast trough-shaped recesses 47 or radial channel sections are provided, only one of which can be seen in FIG. 4, and which then eventually open into the cast space 48.

In the exemplary embodiment shown, the alignment recess 35 for the alignment pin 34 is arranged in one of the two first-mentioned trough-shaped recesses 44. In this case, the relevant trough-shaped recess 44 is widened radially on the outside in the area of the alignment pin 34 in a circumferential direction relative to the radially inner transverse dimensions such that the alignment pin 34 is surrounded by the trough-shaped recess 44 over its entire circumference.

Figure 5:
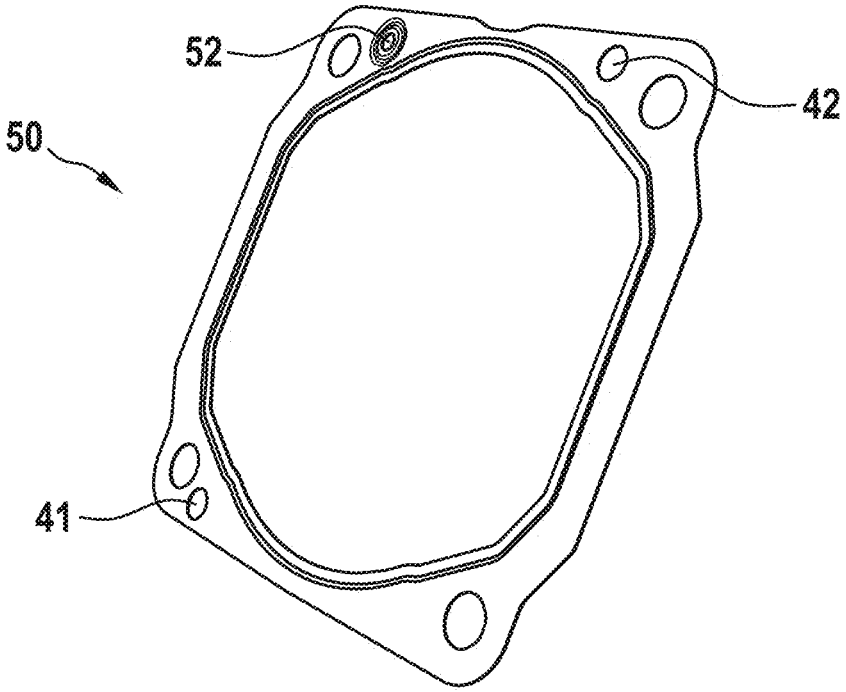
FIG. 5 is a perspective view of a flat seal of the axial piston machine of FIG. 1.

FIG. 5 shows a flat seal 50 of the axial piston machine of FIG. 1, which is clamped between the two housing parts 14, 16, more specifically between their two abutments 20, 26. The flat seal 50 has two through-recesses 41, 42 through which the two fitting pins 31, 32 extend.

The second through-recess 42 of the flat seal 50 through which the second fitting pin 32 extends is in the form of a slotted hole, and corresponds to the form of the slotted hole of the second fitting recess 22. This ensures that the first fitting pin 31, even if it is in one of its extreme positions due to tolerances or manufacturing inaccuracies, does not impair the correct position and thus the function of the flat seal 50.

A breakthrough 52 of the flat seal 50 seals a fluid channel from the high-pressure connection A to the adjustment device 2 on the pot-shaped housing part 14.

The flat seal 50 thus has two functions: sealing the housing and sealing the channel (control oil bore) to report the high pressure.

Figure 6:
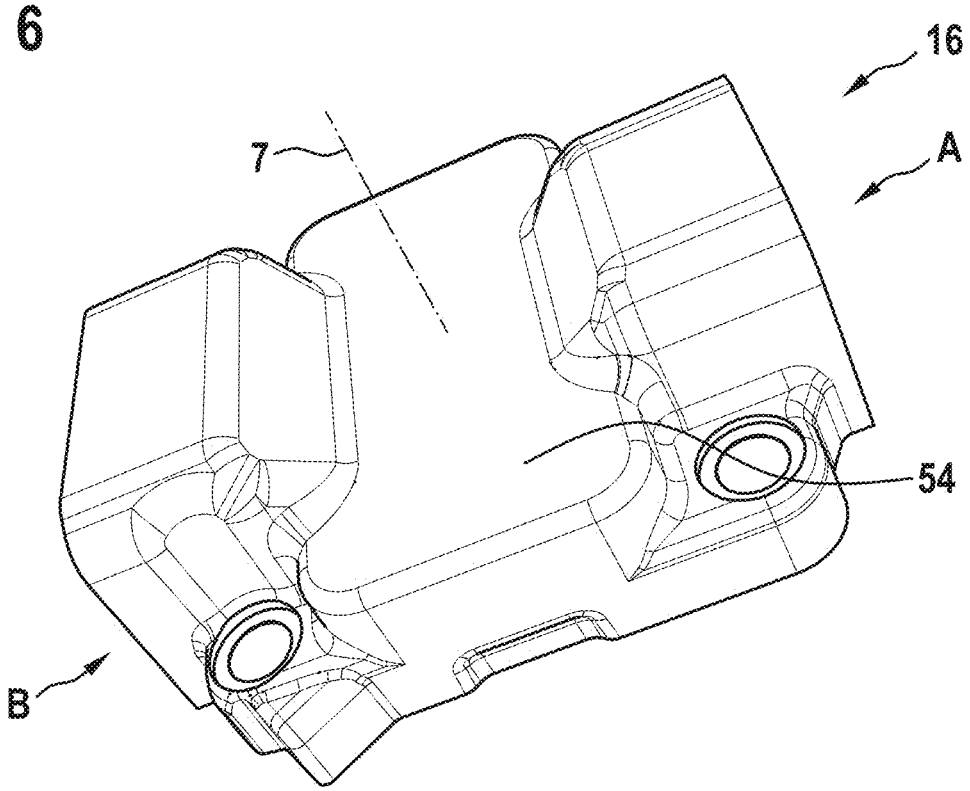
FIG. 6 is a further perspective view of the cover-like housing part of the axial piston machine of FIG. 1.

FIG. 6 shows an outside perspective view of the cover-like housing part 16 from FIGS. 1, 3 and 4. The two work connections A, B of the axial piston machine are formed on opposite sides of the cover-like housing part 16.

An outer flattened section 54 of the cover-like housing part 16 is formed between the two work connections A, B, which is set back along the axis of rotation 7. This serves to save materials.

The flattened section 54 extends transversely to the axis of rotation 7 up to the edge of the cover-like housing part 16 and up to the work connections A, B. In this way, the cover-like housing part 16 has the required stiffness, wherein in particular the maximum deflection of the housing part 16 under load is small, such that the flat seal 50 (see FIG. 5) seals properly.

Figure 7:
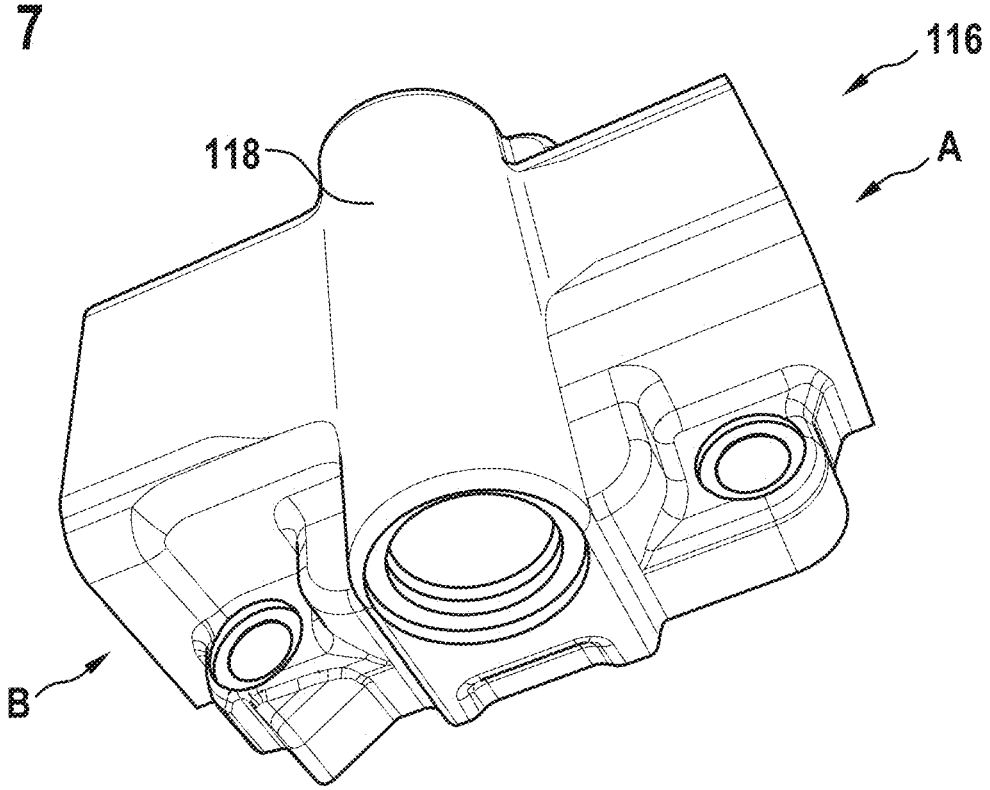
FIG. 7 is a perspective view of a deviating exemplary embodiment of the cover-like housing part.

FIG. 7 shows a perspective outside view of a deviating exemplary embodiment of the cover-like housing part 116, in which a pre-compression volume 118 is arranged between the two work connections A, B. The pre-compression volume 118 is configured as a substantially circular cylindrical blind hole, the central axis of which crosses the axis of rotation 7 perpendicularly, wherein the two work connections A, B face perpendicularly away from the central axis. The blind hole is pre-cast and drilled by machining. The open side of the blind hole is sealed with a closing screw with sealing ring (not shown) in a fluid-tight manner.

Within the cover-like housing part 116, a (not visible) channel in the form of a straight bore is provided, which connects the pre-compression volume 118 to the distribution plate 12. A small bore is provided in the distribution plate 12 in the circumferential direction between the two kidney-shaped control openings, such that a cylinder of the cylinder drum 5 is fluidically connected to the pre-compression volume 118 via its cylinder opening 10 (see FIG. 1) when it is positioned or moved between the kidney-shaped control openings.

Figure 8:
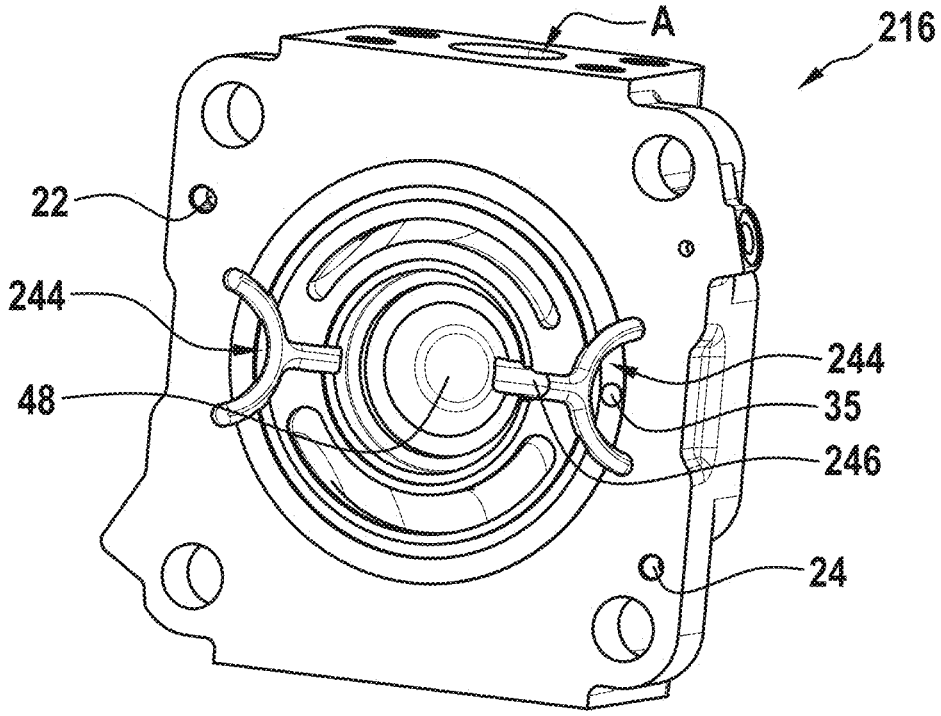
FIG. 8 is a perspective view of another example of a cover-like housing piece for the axial piston machine of FIG. 1.

FIG. 8 shows a cover-like housing part 216, which can be attached to the pot-like housing piece 14 of the axial piston machine of FIG. 1 instead of the cover-like housing piece 16. A different design of the two radial recesses 244 opposite one another relative to the axis of rotation 7 (not shown in FIG. 8) is shown. The two radial recesses 244 are not widened at their outer end sections in the circumferential direction, but are divided in two. The two radial recesses 244 each have an approximately y-shaped design with consistent cross-sections. More specifically, in the exemplary embodiment shown, the two recesses 244 each have a radially inner rectilinear section and a radial outer arcuate section.

The alignment recess 35 for the alignment pin 34 (shown in FIG. 1) is arranged between the two end sections of the radial outer arcuate section of the one (left in FIG. 8) radial recess 244.

Figure 9:
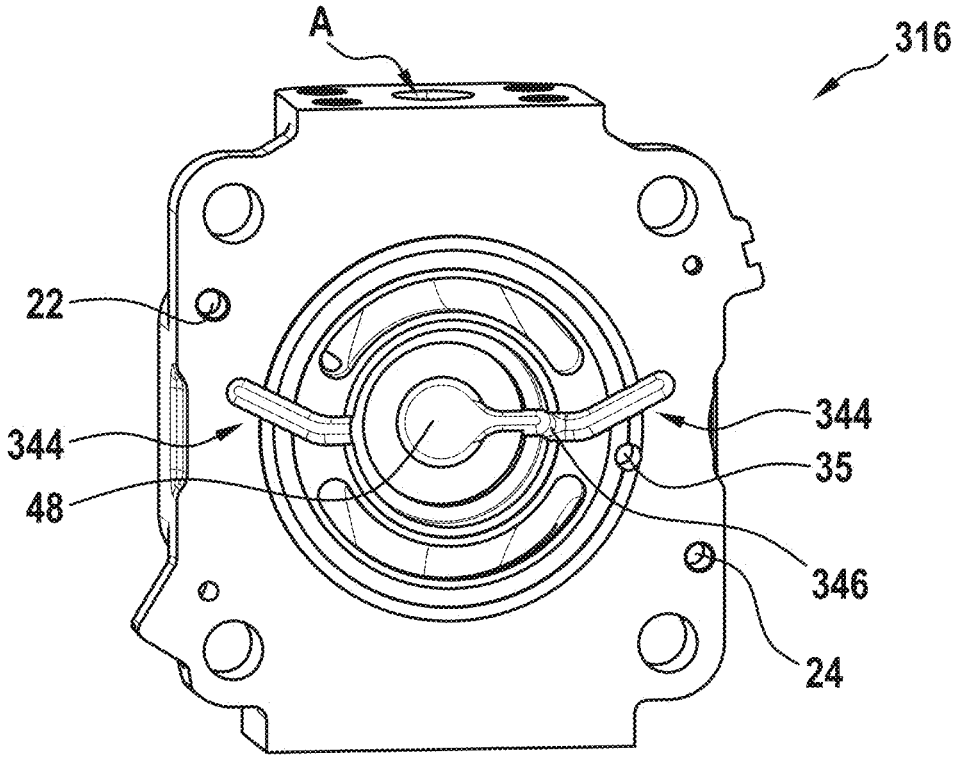
FIG. 9 is a perspective view of another example of a cover-like housing part for the axial piston machine of FIG. 1.

FIG. 9 shows a cover-like housing part 316, which can be attached to the pot-like housing piece 14 of the axial piston machine of FIG. 1 instead of the cover-like housing piece 16. A different design of the two cast radial recesses 344 opposite one another relative to the axis of rotation 7 is shown. The two radial recesses 344 are angled. Each radial recess 344 has a radially aligned inner section and an inclined outer end section. The two inclined outer end sections are both inclined towards the high-pressure kidney.

The alignment recess 35 for the alignment pin 34 (shown in FIG. 1) is arranged adjacent to the end section of the one radial recess 344 (shown in FIG. 9).

In both cover-like housing parts 216; 316 of FIGS. 8 and 9, the radial recess 244; 344 (shown on the right in each case) is extended in a stepped manner up to the cast space 48, such that it is also pressure-equalized with the (other) interior of the housing. To this end, a cast axial recess 246; 346 is provided, which together with the outer ring of the rolling bearing 18 forms an axial channel.

With both cover-like housing parts 216; 316 of FIGS. 8 and 9, a mechanical reinforcement of the cover-like housing part 216; 316 results.

Figure 10:
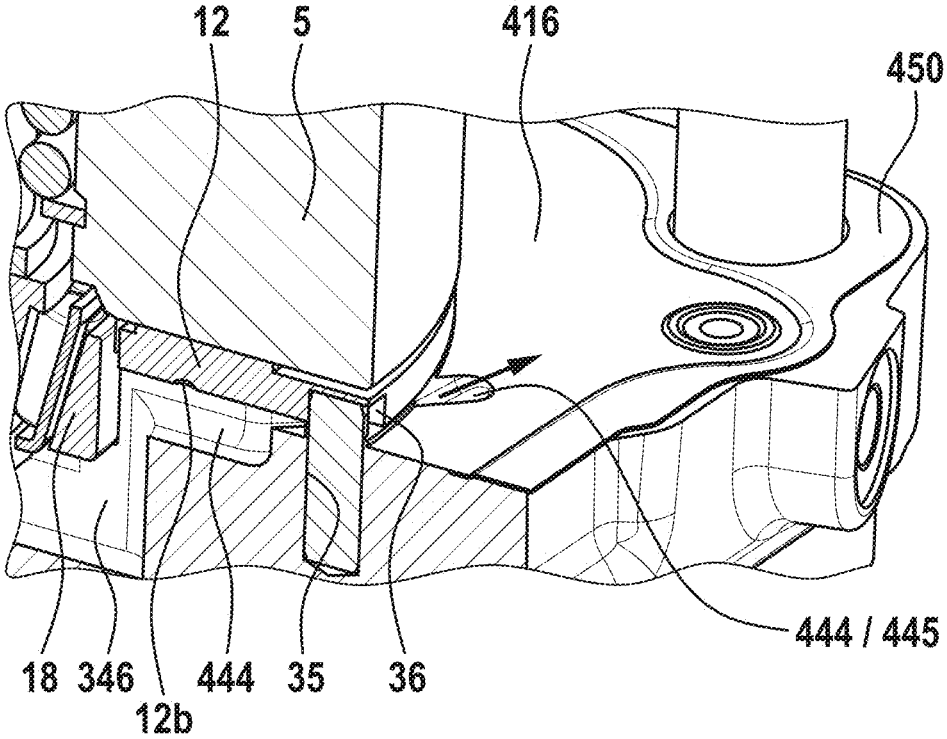
FIG. 10 is a sectioned perspective view of another example of a cover-like housing piece for the axial piston machine of FIG. 1.

FIG. 10 is a sectioned perspective view of a further exemplary embodiment of a cover-like housing part 416 with further components of the axial piston machine of FIG. 1.

In the distribution plate 12 in the circumferential direction of the cylinder drum 5 just before the low-pressure kidney, the control bore 12*a* shown in FIG. 3 is provided, which is fluidically connected to the cast radial recess 444. This fluidic connection is realized via a comparatively short control groove 12*b* running in the circumferential direction, which is formed in the side of the distribution plate 12 abutting the abutment area 39 of the cover-like housing part 416. Only one end section of this control groove 12*b* with a small cross-section is shown in FIG. 10. This results in a relief flow path from a cylinder pressurized with a high pressure via its opening 10 provided in the cylinder drum 5 through the control bore 12*a* along the control groove 12*b* and via the radial cast groove or recess 444 towards the interior of the housing. This relief flow path is advantageous when the axial piston machine is operating as a pump with a minimum swing angle to compensate only for leakage of a circuit with a hydraulic consumer that is under load.

In accordance with the disclosure, the radial cast groove or recess 444 is largely comparable to the radial cast recess 344 of FIG. 9. In contrast to the recess 344 of FIG. 9, a slope 445 is formed at the radial outer end section of the groove bae of the recess 444 in the area of the outer circumferential area of the distribution plate 12, of which only one (radial outer) part can be seen in FIG. 10. This slope 445 may also be referred to as a guide surface or a guide ramp for the pressure means and is cast together with the cover-like housing part 416. Due to the slope 445, the pressure means, which in the case of oil is also referred to as the control oil, and which flows via this relief flow path, is deflected away from the flat seal 450 according to the arrow and directed against the inner wall of the pot-like housing part.

Figure 11:
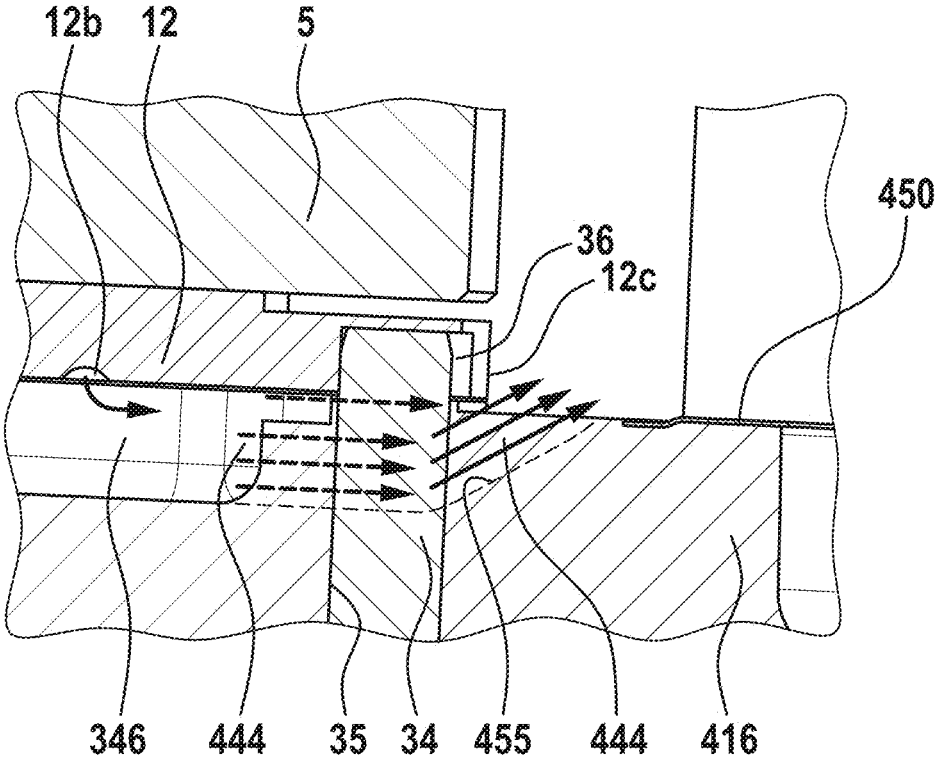
FIG. 11 is a sectioned view of the cover-like housing part of FIG. 10.

FIG. 11 is a sectioned view of the cover-like housing part 416 of FIG. 10. It is contemplated that the slope 445 extends at its radial inner (end) section to below the outer edge 12*c* of the distribution plate 12. Thus, when considering the direction of flow of the pressure means from radially inwards to radially outwards, the slope 445 starts further radially inwards than the outer edge 12*c* of the distribution plate 12. In other words, the deflection of the pressure means already begins below the outer edge 12*c* of the distribution plate 12.

If space is available, the start of the slope 445 may alternatively be arranged outside of the outer edge 12*c* of the distribution plate 12 in order to reduce the cross-section of the cast groove only after the outer edge 12*c* of the distribution plate 12 in order to thereby avoid constriction of the relief flow path. As the start of the slope 445 outside the outer edge 12*c* is already in the interior of the housing, the constriction has less negative influence in this regard than when the slope 445 already starts within the outer edge 12*c*. In the case of a compact design of the interior of the housing, it is possible that the slope 445 must then be steeper.

The depressurized pressure means (control oil) may not now come into direct contact with the flat seal 450, which would place it under adverse stress. There are also dirt particles or metal particles (due to cavitation erosion) in the depressurized pressure medium (control oil), which are therefore also not thrown directly onto the flat gasket 450. This prevents the flat seal 450 from leaking. This reduces risk to people and the environment.

LIST OF REFERENCE NUMBERS

1 Swashplate
2 Adjustment device
3 Extension spring
4 Piston
5 Cylinder drum
6 Drive shaft
7 Axis of rotation
8 Compression spring
9 Cylinder opening
12 Distribution plate
12*a* Control opening/Control bore
12*b* Control groove
12*c* Outer edge
14 Pot-like housing part
16 Cover-like housing part
18 Rolling bearing
20 First abutment
21 First fitting recess
22 Second fitting recess (slotted hole)
23 Third fitting recess
24 Fourth fitting recess
26 Second abutment
31 First fitting pin
32 Second fitting pin
34 Alignment pin
35 Alignment recess
36 Alignment recess
38 Inner case section
41 Through-recess for the first fitting pin (slotted hole)
42 Through-recess for the second fitting pin
44 Cast radial recess
46 Cast axial recess
47 Further cast radial recess

48 Cast space
50 Flat seal
52 Breakthrough
54 Flattened section
116 Cover-like housing part
118 Pre-compression volume
216 Cover-like housing part
244 Cast radial recess
246 Cast axial recess
316 Cover-like housing part
344 Cast radial recess
346 Cast axial recess
416 Cover-like housing part
444 Cast radial recess
445 Slope
450 Flat seal
A Work connection/High-pressure connection
B Work connection/Low-pressure connection

What is claimed is:

1. A hydrostatic axial piston machine, comprising:

a housing;

a drive shaft rotatably mounted in the housing about an axis of rotation, wherein the housing comprises a pot-like housing part having a first abutment and a cover-like housing part having a second abutment, and wherein the two abutments abut each other in a sealing manner;

a first fitting pin inserted precisely into a first fitting recess of the first abutment on the one hand and into a second fitting recess of the second abutment on the other hand; and a second fitting pin provided on a side opposite the axis of rotation and inserted precisely into a third fitting recess of the first abutment on the one hand and into a fourth fitting recess of the second abutment on the other hand, wherein the second fitting recess has a radial widening relative to the axis of rotation, and wherein the second fitting recess is a slotted hole and/or a fitting groove.

2. The axial piston machine according to claim 1, wherein a radial extension of the second fitting recess is only a maximum of 7% greater than an extension of the second fitting recess in the circumferential direction.

3. The axial piston machine according claim 1, wherein all four fitting recesses are formed as respective blind holes.

4. The axial piston machine according to claim 1, wherein the two abutments of the two housing parts lie in a respective plane and are completely circumferential, and wherein a flat seal is arranged between the two abutments which has two through-recesses through which the two fitting pins extend.

5. The axial piston machine according to claim 4, wherein the through-recess for the first fitting pin has a radial widening relative to the axis of rotation, and wherein the through-recess is a slotted hole.

6. The axial piston machine according to claim 1, wherein the two housing parts are fastened to one another by way of a plurality of screws, and wherein the pot-like housing part has blind threaded holes for the screws.

7. The axial piston machine according to claim 1, further comprising a distribution plate having two kidney-shaped control openings clamped against the cover-like housing part, one of which is configured to act as a high-pressure kidney and the other of the two kidney-shaped control openings of which is configured as a low-pressure kidney during operation of the axial piston machine, and wherein the drive shaft is mounted in the cover-like housing part by way of a rolling bearing, and wherein the distribution plate has a central recess having an inner edge, by way of which the distribution plate is mounted on an outer ring of the rolling bearing.

8. The axial piston machine according to claim 7, wherein in an abutment region of the cover-like housing part, against which the distribution plate is clamped, at least one cast radial recess is provided, extending in the radial direction and which is further formed by the distribution plate to form a radial channel section connecting an outer circumferential region of the distribution plate and thus an interior of the housing to the outer ring of the rolling bearing.

9. The axial piston machine according to claim 8, wherein a control opening is provided in the distribution plate that is fluidically connected to the cast radial recess, and wherein a radial outer end section of a groove base of the cast radial recess has a slope in the area of the outer edge of the distribution plate.

10. The axial piston machine according to claim 8, wherein, when viewed along the axis of rotation, a cast space is provided axially adjacent to the rolling bearing on a side of the rolling bearing opposite the distribution plate in the cover-like housing part, wherein at least one cast axial recess is formed in an inner case section of the cover-like housing part, against which the outer ring of the rolling bearing abuts, extending in the axial direction, and which is further formed by the outer ring to an axial channel, connecting the radial channel section to the cast space.

11. The axial piston machine according to claim 8, wherein an alignment recess of the cover-like housing part is arranged in the cast radial recess.

12. The axial piston machine according to claim 8, wherein an alignment recess of the cover-like housing part is arranged between two arms of the cast radial recess.

13. The axial piston machine according to claim 8, wherein an alignment recess of the cover-like housing part is arranged adjacent to the cast radial recess.

14. The axial piston machine according to claim 7, further comprising an alignment pin inserted into an alignment recess of the cover-like housing part on the one hand and into an alignment recess of the distribution plate on the other hand.

15. The axial piston machine according to claim 1, wherein two work connections of the axial piston machine are formed on the cover-like housing part, and wherein a flattened section and/or recess of the cover-like housing part is formed on an outer side of the cover-like housing part between the two work connections that is set back along the axis of rotation.

16. The axial piston machine according to claim 1, wherein two work connections of the axial piston machine are formed in the cover-like housing part, and wherein a pre-compression volume is arranged in the cover-like housing part between the two work connections.

* * * * *